US011228137B2

(12) United States Patent
Xu et al.

(10) Patent No.: US 11,228,137 B2
(45) Date of Patent: Jan. 18, 2022

(54) WATERPROOF CONNECTOR

(71) Applicant: DONGGUAN LEADER PRECISION INDUSTRY CO., LTD, Dongguan (CN)

(72) Inventors: Hongqiang Xu, Dongguan (CN); Lijun Xu, Dongguan (CN); Mengjie Peng, Dongguan (CN)

(73) Assignee: DONGGUAN LEADER PRECISION INDUSTRY CO., LTD, Dongguan (CN)

( * ) Notice: Subject to any disclaimer, the term of this patent is extended or adjusted under 35 U.S.C. 154(b) by 1 day.

(21) Appl. No.: 17/034,717

(22) Filed: Sep. 28, 2020

(65) Prior Publication Data

US 2021/0119373 A1 Apr. 22, 2021

(30) Foreign Application Priority Data

Oct. 22, 2019 (CN) ..... 201911009163.5

(51) Int. Cl.
*H01R 13/52* (2006.01)
*H01R 13/10* (2006.01)
*H01R 13/502* (2006.01)

(52) U.S. Cl.
CPC ..... *H01R 13/521* (2013.01); *H01R 13/10* (2013.01); *H01R 13/502* (2013.01)

(58) Field of Classification Search
CPC .... H01R 13/521; H01R 13/10; H01R 13/502; H01R 13/5219; H01R 24/60; H01R 2201/06
See application file for complete search history.

(56) References Cited

U.S. PATENT DOCUMENTS 9,871,318 B2 * 1/2018 Wang ..... H01R 13/516
10,074,930 B2 * 9/2018 Zhu ..... H01R 13/5202
(Continued)

FOREIGN PATENT DOCUMENTS

CN 105655796 A 6/2016
CN 106785645 A 5/2017
(Continued)

OTHER PUBLICATIONS

Chinese Office Action and Search Report for Chinese Application No. 201911009163.5, dated Jul. 31, 2020, with English translation of the Search Report.

*Primary Examiner* — Abdullah A Riyami
*Assistant Examiner* — Nader J Alhawamdeh
(74) *Attorney, Agent, or Firm* — Birch, Stewart, Kolasch & Birch, LLP

(57) ABSTRACT

A waterproof connector includes a first terminal module, a second terminal module, a covering module and an outer shell. The first terminal module includes a first insulating body and a number of first terminals. The second terminal module includes a second insulating body and a number of second terminals. The first insulating body is provided with a first hollow groove. The second insulating body is provided with a second hollow groove. The outer shell is provided with a top surface. The top surface is provided with a first glue pouring port communicating with the second hollow groove. The waterproof connector is provided with a first sealant poured into the first hollow groove, and a second sealant poured into the second hollow groove. The second sealant and the first sealant are two pieces. As a result, the waterproof performance of the waterproof connector is improved.

20 Claims, 16 Drawing Sheets

(56) References Cited

U.S. PATENT DOCUMENTS

| | | | | |
|---|---|---|---|---|
| 11,152,740 | B2 * | 10/2021 | Xu | H01R 13/5216 |
| 2017/0338585 | A1 * | 11/2017 | Wang | H01R 13/5202 |
| 2018/0040974 | A1 * | 2/2018 | Peng | H01R 13/5202 |

FOREIGN PATENT DOCUMENTS

| | | | |
|---|---|---|---|
| CN | 206225652 | U | 6/2017 |
| CN | 206480825 | U | 9/2017 |
| CN | 208045847 | U | 11/2018 |
| CN | 208142445 | U | 11/2018 |
| CN | 109103678 | A | 12/2018 |
| CN | 109449634 | A | 3/2019 |
| CN | 109742593 | A | 5/2019 |
| CN | 110061382 | A | 7/2019 |
| CN | 209183823 | U | 7/2019 |
| CN | 209329276 | U | 8/2019 |
| CN | 110247225 | A | 9/2019 |
| CN | 209374776 | U | 9/2019 |
| CN | 209418870 | U | 9/2019 |
| JP | 2010-186563 | A | 8/2010 |
| JP | 2017-112098 | A | 6/2017 |
| JP | 2019-3817 | A | 1/2019 |

* cited by examiner

WATERPROOF CONNECTOR

CROSS-REFERENCE TO RELATED APPLICATION

This patent application claims priority of a Chinese Patent Application No. 201911009163.5, filed on Oct. 22, 2019 and titled "WATERPROOF CONNECTOR", the entire content of which is incorporated herein by reference.

TECHNICAL FIELD

The present disclosure relates to a waterproof connector which belongs to a technical field of connectors.

BACKGROUND

Existing connectors such as Type C receptacle connectors usually include a tongue plate, a plurality of conductive terminals exposed on a surface of the tongue plate, and a metal shell sleeved on a periphery of the tongue plate. In order to improve the waterproof level of the connector, the existing connectors usually adopt injection molding to combine the conductive terminals and an insulating body. In addition, the existing connectors also use glue filling to improve the sealing performance of the connectors. However, the existing glue filling method adopts one-time glue filling, which has a long glue filling path and easily causes a problem of poor sealing.

SUMMARY

An object of the present disclosure is to provide a waterproof connector with better sealing performance.

In order to achieve the above object, the present disclosure adopts the following technical solution: a waterproof connector comprising a first terminal module, a second terminal module, a covering module and an outer shell. The first terminal module comprises a first insulating body and a plurality of first terminals embedded in the first insulating body. The first insulating body defines a first hollow groove. The second terminal module comprises a second insulating body and a plurality of second terminals embedded in the second insulating body. The second insulating body defines a second hollow groove. The covering module covers the first terminal module and the second terminal module. The outer shell encloses the first terminal module, the second terminal module and the covering module. The outer shell has a top surface which is provided with a first glue pouring port communicating with the second hollow groove. The waterproof connector is provided with a first sealant poured into the first hollow groove and a second sealant poured into the second hollow groove from the first glue pouring port. The second sealant and the first sealant are two pieces.

Compared with the prior art, in the present disclosure, the second sealant and the first sealant are arranged in a two-piece form but combined as a whole, which reduces the flow distance of the sealant during each potting and achieves a better waterproof effect.

DETAILED DESCRIPTION

Figure 1:
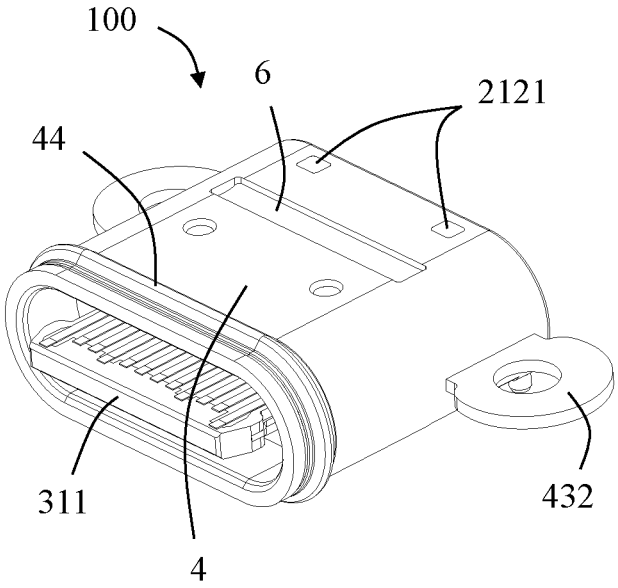
FIG. 1 is a perspective view of a waterproof connector in accordance with an embodiment of the present disclosure.

Referring to FIGS. 1 to 7, the present disclosure discloses a waterproof connector 100 including a first terminal module 1, a second terminal module 2, a covering module 3 covering the first terminal module 1 and the second terminal module 2, and a shell 4 surrounding the first terminal module 1, the second terminal module 2 and the covering module 3. In the illustrated embodiment of the present disclosure, the waterproof connector 100 is a Type C receptacle connector for being mounted on a circuit board (not shown).

Referring to FIGS. 11 to 14, the first terminal module 1 includes a first insulating body 11 and a plurality of first terminals 12 embedded in the first insulating body 11. In an embodiment of the present disclosure, the first terminals 12 are insert-molded in the first insulating body 11. The first insulating body 11 has a first hollow groove 111, a first rear body 112 located behind the first hollow groove 111, and a first front body 113 located in front of the first hollow groove 111. From a structural point of view, each first terminal 12 is provided with a flat plate-shaped first contact portion 121, a first connection portion 122 exposed in the first hollow groove 111, and a first welding portion 123 extending from the first connection portion 122.

Referring to FIGS. 11 to 14, the second terminal module 2 includes a second insulating body 21 and a plurality of second terminals 22 embedded in the second insulating body 21. In an embodiment of the present disclosure, the second terminals 22 are insert-molded in the second insulating body 21. The second insulating body 21 has a second hollow groove 211, a second rear body 212 located behind the second hollow groove 211, and a second front body 213 located in front of the second hollow groove 211. The second rear body 212 is provided with a protrusion 2121 protruding upwardly to fit with the shell 4. From a structural point of view, each second terminal 22 is provided with a flat plate-shaped second contact portion 221, a second connection portion 222 exposed in the second hollow groove 211, and a second welding portion 223 extending from the second connection portion 222.

Figure 13:
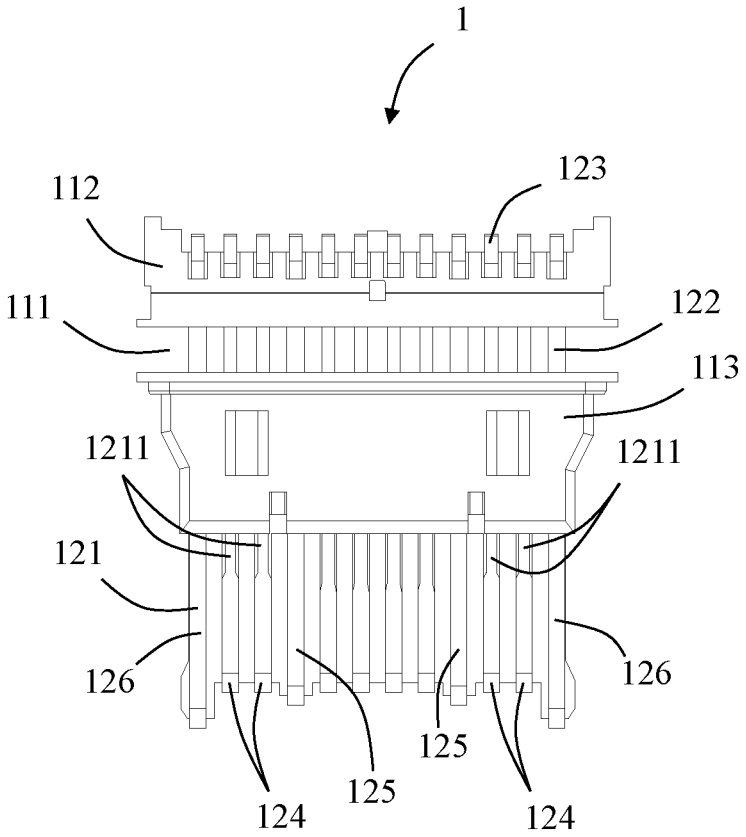
FIG. 13 is a top view of a first terminal module in FIG. 12.
Figure 14:
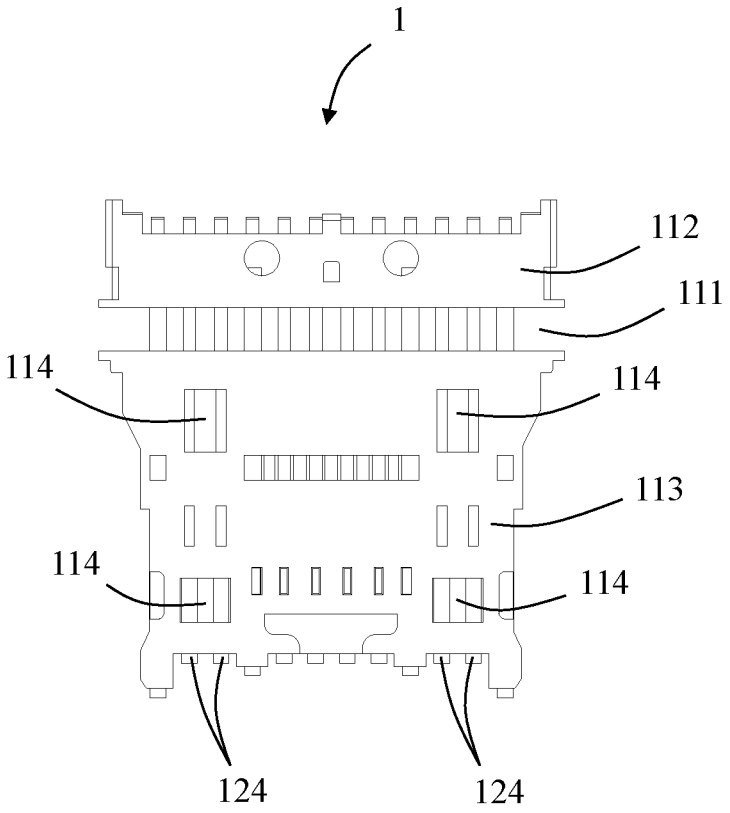
FIG. 14 is a bottom view of FIG. 13.

Referring to FIG. 13, from a functional point of view, the first terminals 12 include a first differential pair of signal terminals 124, a first power terminal 125 and a first ground terminal 126. Referring to FIG. 14, the first front body 113 defines a first high-frequency signal hole 114 which exposes part of the first contact portions 121 of the first differential pair of signal terminals 124 to the first front body 113. From a structural point of view, each first contact portion 121 of the first differential pair of signal terminals 124 is provided with a first contraction portion 1211 with a narrower width. In addition, the first power terminal 125 and the first ground terminal 126 are made of copper alloy with ultra-high conductivity (for example, NKE012 with a conductivity of 90%), and the remaining first terminals 12 are made of copper alloy (for example, C7025). This setting can improve the quality of signal transmission and meet high frequency requirements. In an embodiment of the present disclosure, a thickness (for example, 0.15 mm) of the first power terminal 125 and a thickness (for example, 0.15 mm) of the first ground terminal 126 are greater than the thickness (for example, 0.12 mm) of the remaining first terminals 12. In other words, the thickness of the first power terminal 125 and the thickness of the first ground terminal 126 are two greater thicknesses than the first terminals 12, so that the first power terminal 125 and the first ground terminal 126 can withstand a relatively large current.

Figure 15:
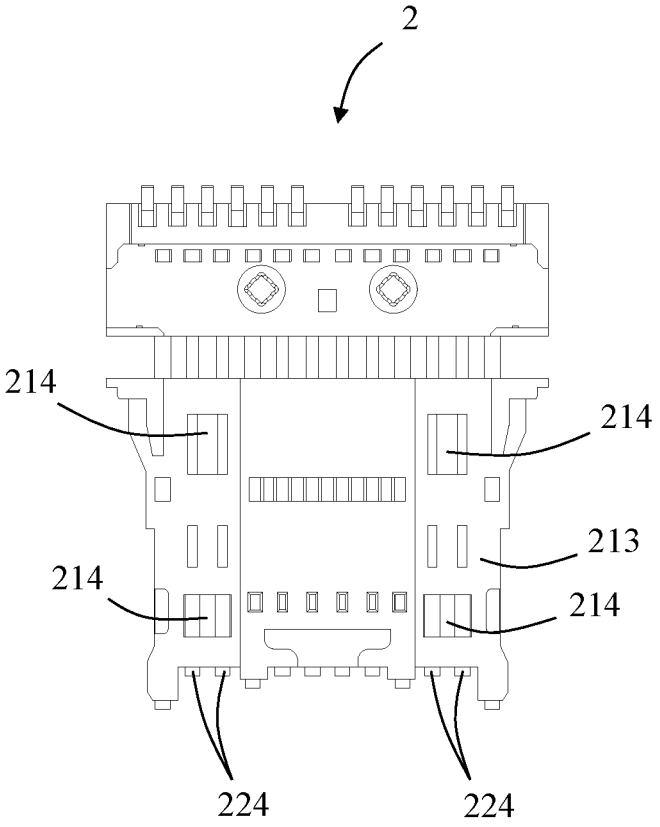
FIG. 15 is a top view of a second terminal module in FIG. 12.
Figure 16:
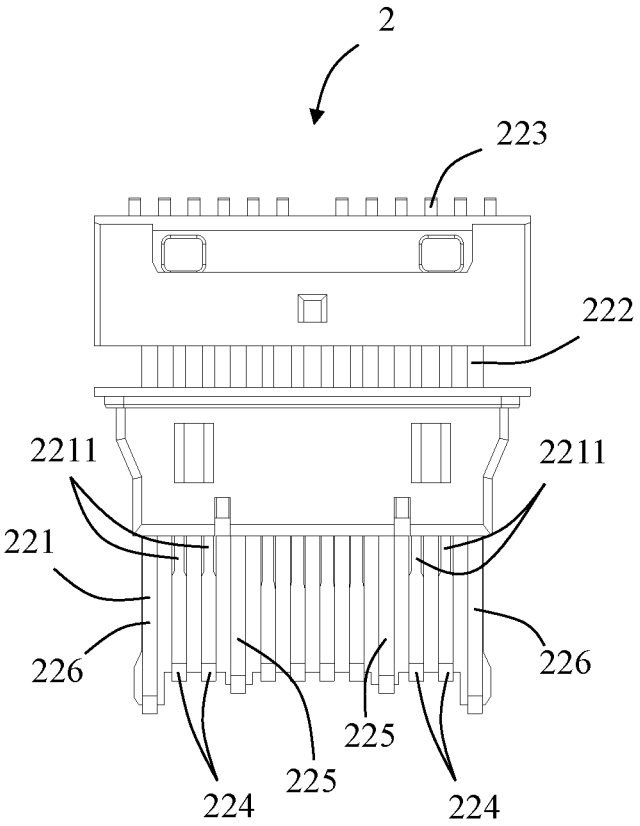
FIG. 16 is a bottom view of FIG. 15.

Referring to FIG. 16, from a functional point of view, the second terminals 22 include a second differential pair of signal terminals 224, a second power terminal 225 and a second ground terminal 226. Referring to FIG. 15, the second front body 213 defines a second high-frequency signal hole 214 which exposes part of the second contact portions 221 of the second differential pair of signal terminals 224 to the second front body 213. From a structural point of view, each second contact portion 221 of the second differential pair of signal terminals 224 is provided with a second contraction portion 2211 with a narrower width. In addition, the second power terminal 225 and the second ground terminal 226 are made of copper alloy with ultra-high conductivity (for example, NKE012 with a conductivity of 90%), and the remaining second terminals 22 are made of copper alloy (for example, C7025). This setting can improve the quality of signal transmission and meet high frequency requirements. In an embodiment of the present disclosure, a thickness (for example, 0.15 mm) of the second power terminal 225 and a thickness (for example, 0.15 mm) of the second ground terminal 226 are greater than the thickness (for example, 0.12 mm) of the remaining second terminals 22. In other words, the thickness of the second power terminal 225 and the thickness of the second ground terminal 226 are two greatest thicknesses among the second terminals 22, so that the second power terminal 225 and the second ground terminal 226 can withstand a relatively large current.

Referring to FIGS. 9 to 12, the covering module 3 includes a third insulating body 31, a shielding sheet 32 embedded in the third insulating body 31, and a shielding sleeve 33 enclosing the third insulating body 31. The third insulating body 31 is provided with a tongue plate 311. The first contact portions 121 of the first terminals 12 and the second contact portions 221 of the second terminals 22 are respectively exposed on a first surface (for example, a lower surface) and a second surface (for example, an upper surface) of the tongue plate 311. The first surface and the second surface are opposite to each other. The shielding sheet 32 separates the first contact portions 121 from the second contact portions 221 to improve the quality of signal transmission. In addition, the shielding sheet 32 is further provided with an extension portion 321. The extension portion 321 has an opening 322 communicating with the first hollow groove 111 and the second hollow groove 211, and a soldering leg 323 for being welded to the circuit board. The extension portion 321 is clamped between the first rear body 112 and the second rear body 212.

Figure 7:
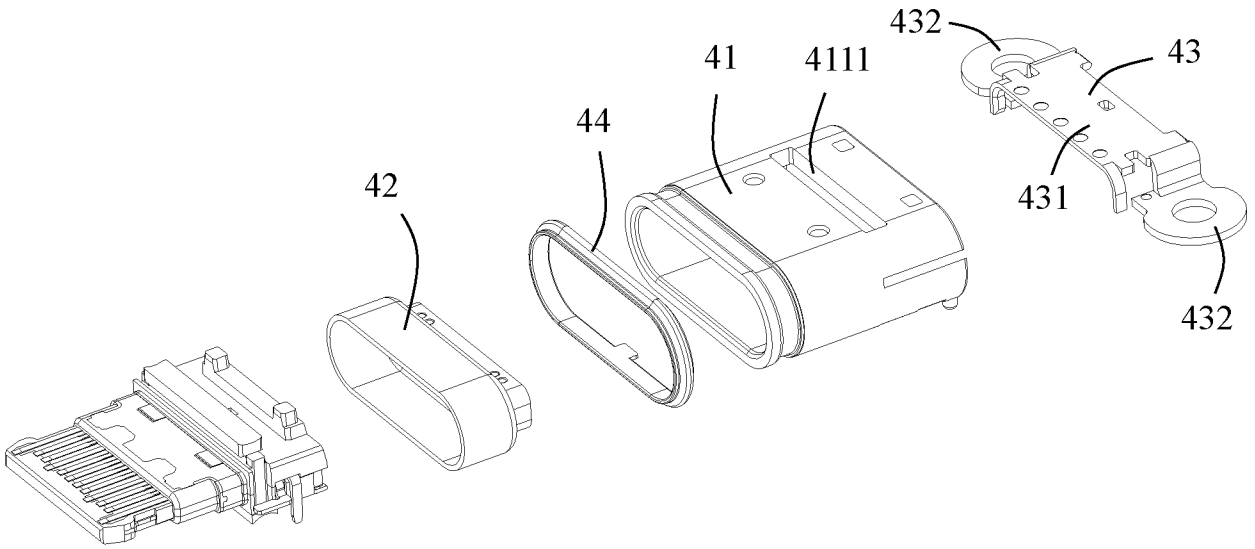
FIG. 7 is a further perspective exploded view of FIG. 4.
Figure 8:
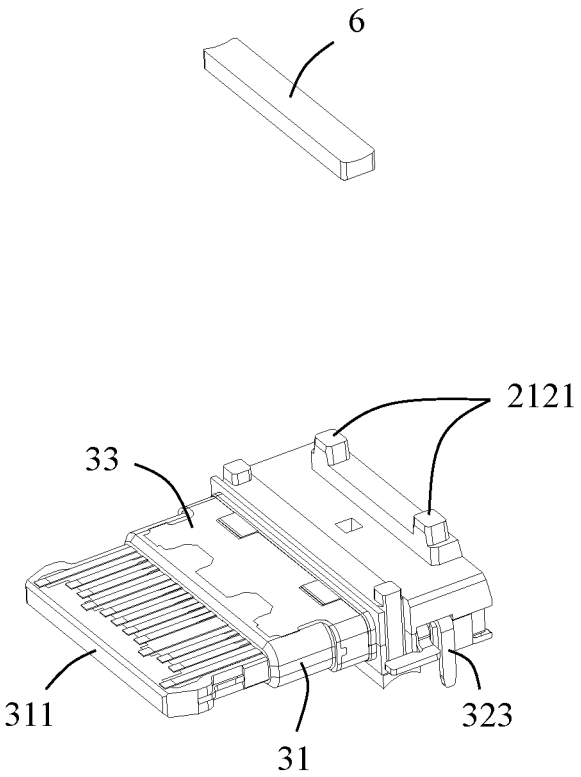
FIG. 8 is a perspective schematic view of a terminal module in FIG. 7 after the second sealant is separated.
Figure 9:
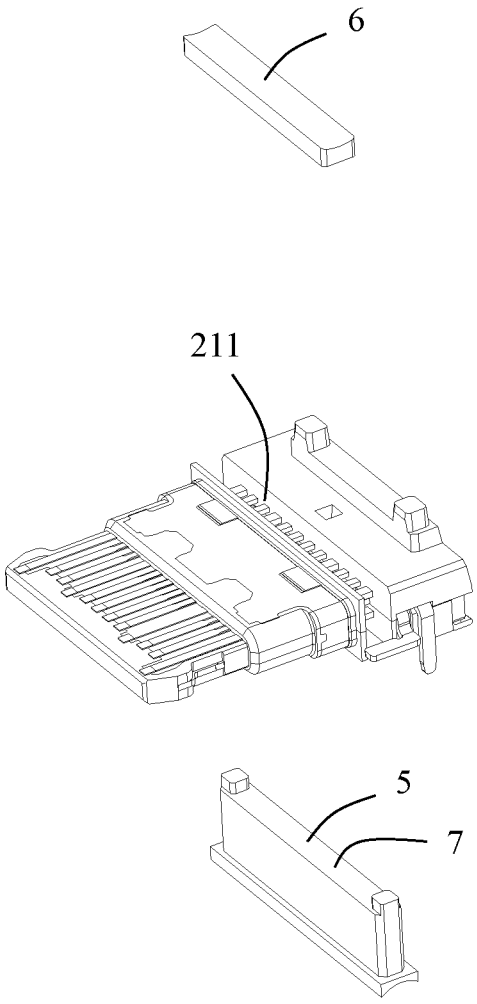
FIG. 9 is a perspective schematic view after the first sealant is further separated on the basis of FIG. 8.
Figure 10:
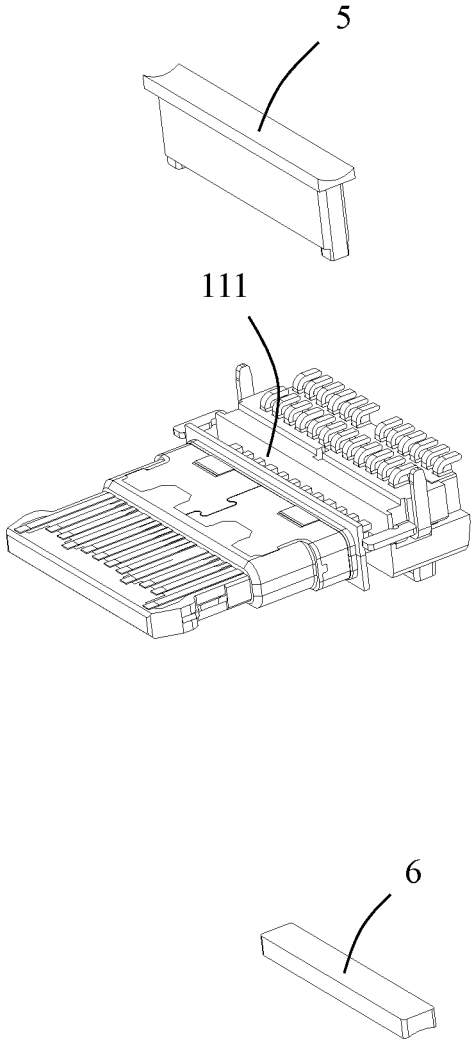
FIG. 10 is a perspective schematic view of FIG. 9 from another angle.
Figure 11:
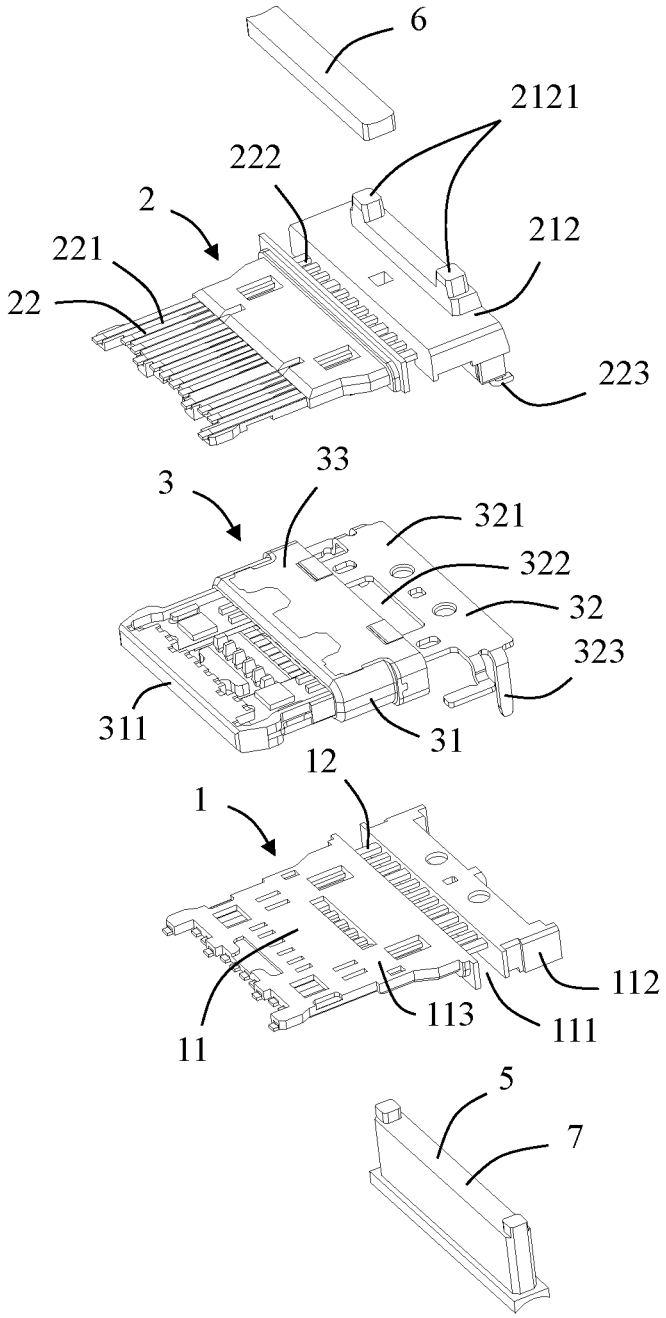
FIG. 11 is a further perspective exploded view of FIG. 9.
Figure 12:
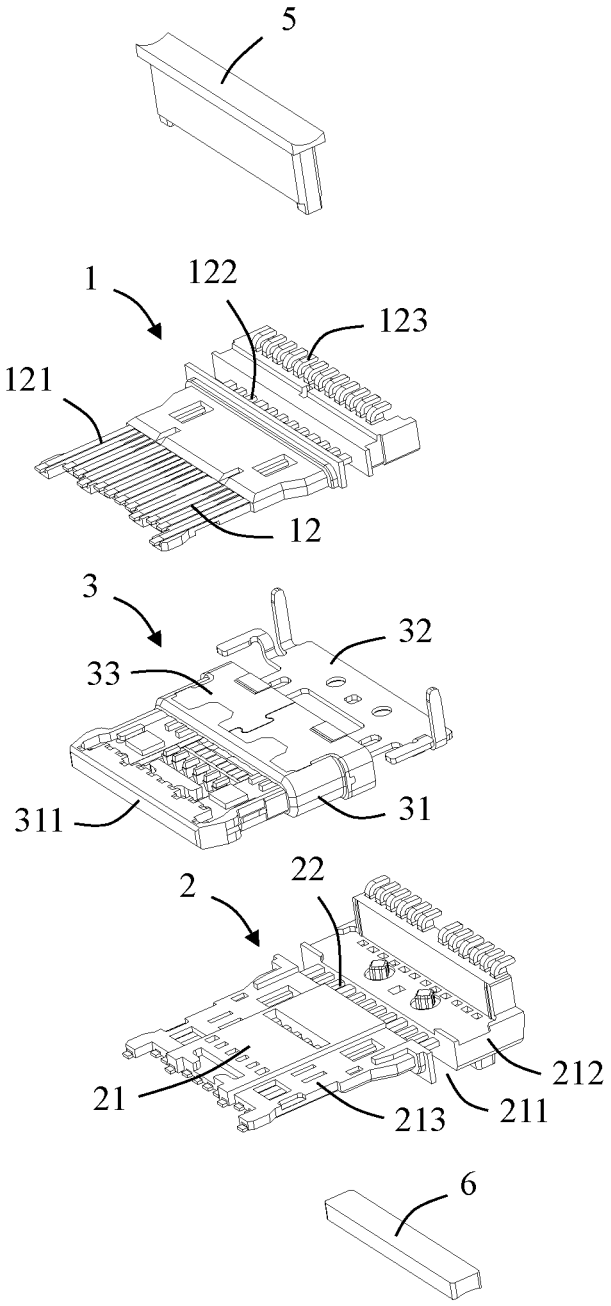
FIG. 12 is an exploded perspective view of FIG. 11 from another angle.

The shell 4 is made of metal material in an embodiment of the present disclosure. Referring to FIG. 7, in the illustrated embodiment of the present disclosure, the shell 4 includes an outer shell 41, an inner shell 42 located in the outer shell 41, and a rear shell 43 connected with the inner shell 42. The waterproof connector 100 is further provided with a sealing ring 44 sleeved on the outer shell 41.

Figure 2:
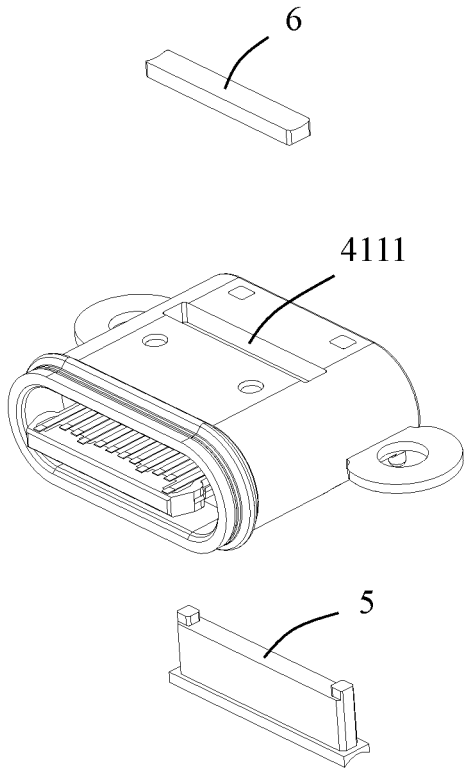
FIG. 2 is a perspective schematic view of FIG. 1 after exploding a second sealant and a first sealant.
Figure 3:
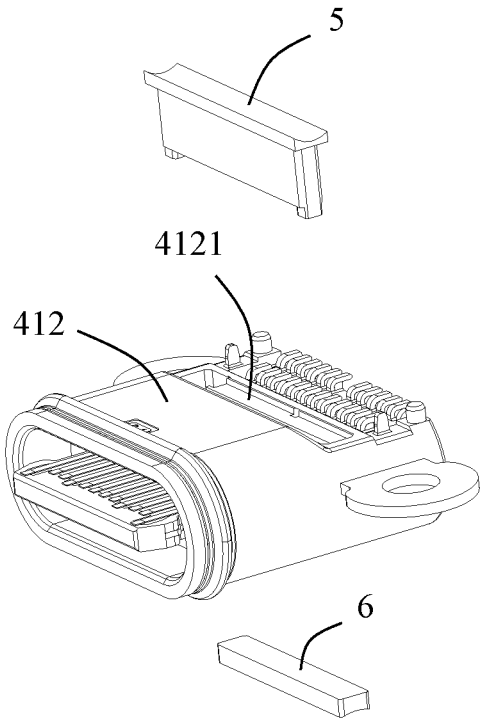
FIG. 3 is a perspective schematic view of FIG. 2 from another angle.
Figure 4:
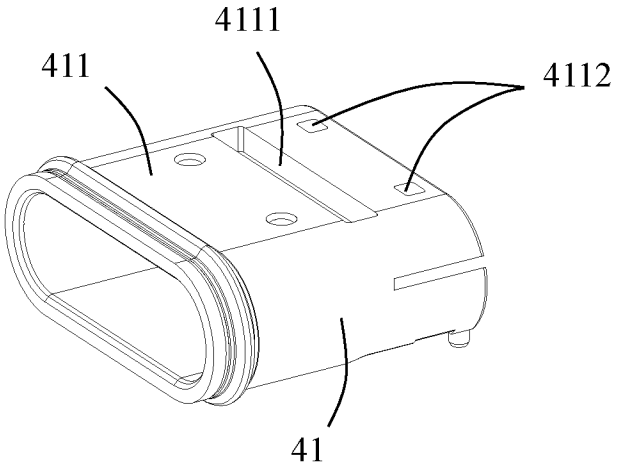
FIG. 4 is a perspective schematic view of FIG. 1 after exploding an outer shell.
Figure 4:
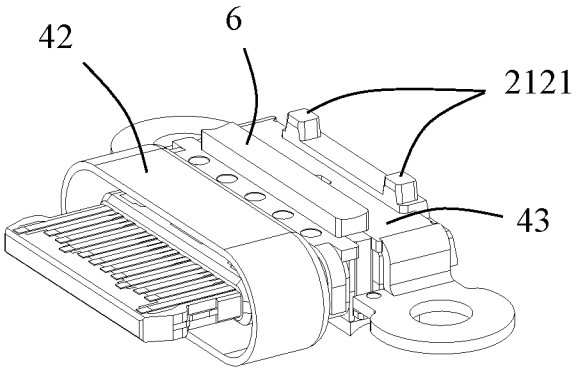
Figure 5:
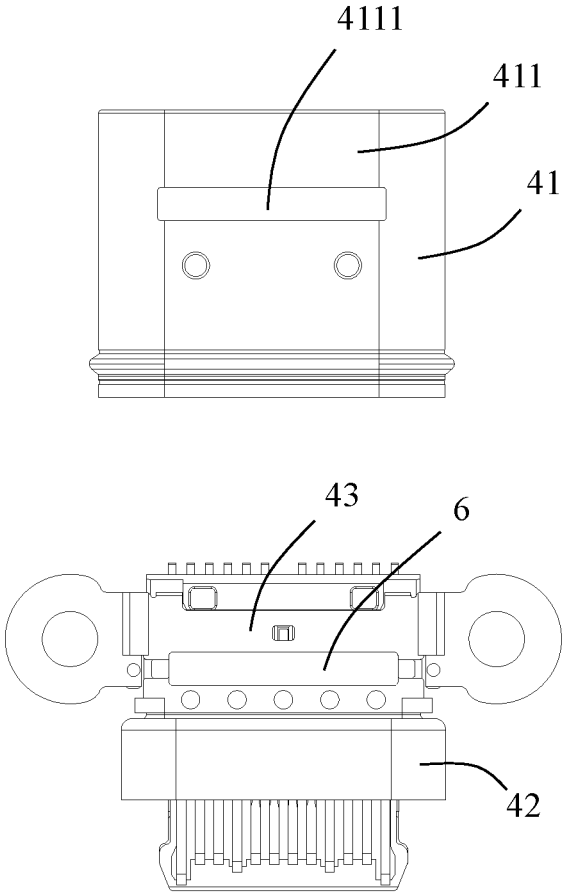
FIG. 5 is a top view of FIG. 4.
Figure 6:
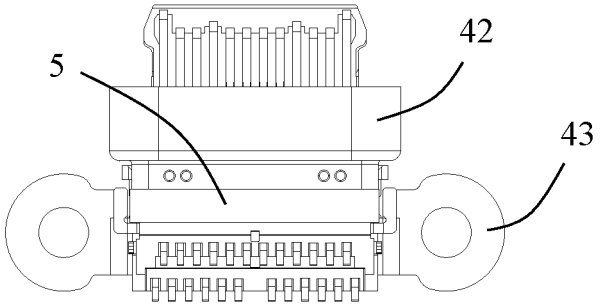
FIG. 6 is a bottom view of FIG. 5.
Figure 6:
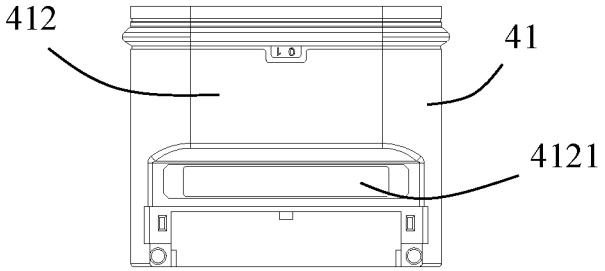

Referring to FIGS. 2 and 3, the outer shell 41 is provided with a top surface 411 and a bottom surface 412. The top surface 411 is provided with a first glue pouring port 4111 (an upper glue pouring port) communicating with the second hollow groove 211, and a through hole 4112 engaged with the protrusion 2121. The bottom surface 412 is provided with a second glue pouring port 4121 (a lower glue pouring port) communicating with the first hollow groove 111.

Referring to FIGS. 1 to 3 and FIGS. 8 to 12, the waterproof connector 100 includes a first sealant 5 (a bottom sealant) poured into the first hollow groove 111 from the second glue pouring port 4121, and a second sealant 6 (an upper sealant) poured into the second hollow groove 211 from the first glue pouring port 4111. The second sealant 6 and the first sealant 5 are two pieces but combined as a whole. The second sealant 6 and the first sealant 5 jointly form an annular-shaped configuration to improve sealing performance. The second sealant 6 and the first sealant 5, which form the annular-shaped configuration, are provided with a cavity 7. The cavity 7 is formed in the middle of the junction of the second sealant 6 and the first sealant 5.

The rear shell 43 has a main body portion 431 located in the middle thereof and mounting portions 432 extending from both sides of the main body portion 431, respectively. The main body portion 431 extends through the cavity 7. The mounting portion 432 is adapted to mount the waterproof connector 100 on the circuit board.

When assembling, firstly, the first terminal module 1, the second terminal module 2 and the covering module 3 are formed into an integral terminal module. Then, the inner shell 42 and the rear shell 43 are sleeved on the terminal module, and then the inner shell 42 and the rear shell 43 are fixed together. Then, the first sealant 5 is poured into the first hollow groove 111 from the second glue pouring port 4121, and the first sealant 5 is poured into the first hollow groove 111 and the opening 322. Then, the outer shell 41 is assembled, and the second sealant 6 is poured into the second hollow groove 211 through the first glue pouring port 4111. Finally, the second sealant 6 and the first sealant 5 jointly form as a whole. Of course, in other embodiments, the opening 322 can also be filled with the second sealant 6.

It should be noted that the terms "first", "second" and "third" used in this application are only used to distinguish component names, and there is no logical order.

The above embodiments are only used to illustrate the present application and not to limit the technical solutions described in the present application. The understanding of this specification should be based on those skilled in the art. Descriptions of directions, such as "front", "back", "left", "right", "top" and "bottom", although they have been described in detail in the above-mentioned embodiments of the present application, those skilled in the art should understand that modifications or equivalent substitutions can still be made to the application, and all technical solutions and improvements that do not depart from the spirit and scope of the application should be covered by the claims of the application.

What is claimed is:

1. A waterproof connector, comprising:

a first terminal module comprising a first insulating body and a plurality of first terminals embedded in the first insulating body, the first insulating body defining a first hollow groove;

a second terminal module comprising a second insulating body and a plurality of second terminals embedded in the second insulating body, the second insulating body defining a second hollow groove;

a covering module integrally combined with the first terminal module and the second terminal module; and an outer shell enclosing the first terminal module, the second terminal module and the covering module, the outer shell having a top surface which is provided with a first glue pouring port communicating with the second hollow groove; wherein the waterproof connector is provided with a first sealant poured into the first hollow groove and a second sealant poured into the second hollow groove from the first glue pouring port; and wherein the second sealant and the first sealant are two pieces.

2. The waterproof connector according to claim 1, wherein the second sealant and the first sealant jointly form an annular-shaped configuration as a whole.

3. The waterproof connector according to claim 2, wherein the second sealant and the first sealant are provided with a cavity; and wherein the waterproof connector further comprises a rear shell, the rear shell comprises a main body portion and mounting portions respectively extending from both sides of the main body portion; and wherein the main body portion extends through the cavity and the mounting portions are adapted for mounting the waterproof connector on a circuit board.

4. The waterproof connector according to claim 1, wherein the covering module comprises a third insulating body and a shielding sheet embedded in the third insulating body, the third insulating body is provided with a tongue plate, each first terminal is provided with a first contact portion exposed on a first surface of the tongue plate, each second terminal is provided with a second contact portion exposed on a second surface of the tongue plate, and the shielding sheet separates the first contact portions from the second contact portions.

5. The waterproof connector according to claim 4, wherein the shielding sheet is provided with an extension portion extending beyond the third insulating body, the extension portion is provided with an opening communicating with the first hollow groove and the second hollow groove, and the second sealant or the first sealant is filled in the opening.

6. The waterproof connector according to claim 5, wherein the first insulating body comprises a first rear body located behind the first hollow groove, the second insulating body comprises a second rear body located behind the second hollow groove, and the extension portion is clamped between the first rear body and the second rear body.

7. The waterproof connector according to claim 4, wherein the waterproof connector is a Type C receptacle connector, the first terminals comprise a first differential pair of signal terminals, a first power terminal and a first ground terminal, the second terminals comprise a second differential pair of signal terminals, a second power terminal and a second ground terminal.

8. The waterproof connector according to claim 7, wherein the first insulating body comprises a first front body located in front of the first hollow groove, the second insulating body comprises a second front body located in front of the second hollow groove, the first front body is provided with a first high-frequency signal hole which exposes part of the first contact portions of the first differential pair of signal terminals to the first front body, and the second front body is provided with a second high-frequency signal hole which exposes part of the second contact portions of the second differential pair of signal terminals to the second front body.

9. The waterproof connector according to claim 7, wherein each first contact portion of the first differential pair of signal terminals comprises a first contraction portion, and each second contact portion of the second differential pair of signal terminals comprises a second contraction portion.

10. The waterproof connector according to claim 7, wherein the first power terminal and the first ground terminal are made of copper alloy with ultra-high conductivity, and the second power terminal and the second ground terminal are made of copper alloy with ultra-high conductivity.

11. The waterproof connector according to claim 7, wherein a thickness of the first power terminal and a thickness of the first ground terminal are two greater thicknesses than the first terminals, and a thickness of the second power terminal and a thickness of the second ground terminal are two greater thicknesses than the second terminals.

12. A waterproof connector, comprising:

a first terminal module comprising a first insulating body and a plurality of first terminals insert-molded in the first insulating body, each first terminal comprising a first contact portion, a first welding portion and a first connection portion connecting the first contact portion and the first welding portion, the first insulating body defining a first hollow groove in which the first connection portions are exposed;

a second terminal module comprising a second insulating body and a plurality of second terminals insert-molded in the second insulating body, each second terminal comprising a second contact portion, a second welding portion and a second connection portion connecting the second contact portion and the second welding portion, the second insulating body defining a second hollow groove in which the second connection portions are exposed;

a covering module being integral with the first terminal module and the second terminal module; and an outer shell enclosing the first terminal module, the second terminal module and the covering module; wherein the waterproof connector is provided with a first sealant poured into the first hollow groove and a second sealant poured into the second hollow groove, the second sealant and the first sealant are integrally formed as a whole so that the first contact portions and the second contact portions are separated from the first welding portions and the second welding portions in a sealed manner.

13. The waterproof connector according to claim 12, wherein the second sealant and the first sealant are provided with a cavity; and wherein the waterproof connector further comprises a rear shell, the rear shell comprises a main body portion and mounting portions respectively extending from both sides of the main body portion; and wherein the main body portion extends through the cavity and the mounting portions are adapted for mounting the waterproof connector on a circuit board.

14. The waterproof connector according to claim 12, wherein the covering module comprises a third insulating body and a shielding sheet insert-molded in the third insulating body, the third insulating body is provided with a tongue plate, the first contact portions are exposed on a first surface of the tongue plate, the second contact portions are exposed on a second surface of the tongue plate, and the shielding sheet separates the first contact portions from the second contact portions.

15. The waterproof connector according to claim 14, wherein the shielding sheet is provided with an extension portion extending beyond the third insulating body, the extension portion is provided with an opening communicating with the first hollow groove and the second hollow groove, and the second sealant or the first sealant is filled in the opening.

16. The waterproof connector according to claim 15, wherein the first insulating body comprises a first rear body located behind the first hollow groove, the second insulating body comprises a second rear body located behind the second hollow groove, and the extension portion is clamped between the first rear body and the second rear body.

17. The waterproof connector according to claim 12, wherein the waterproof connector is a Type C receptacle connector, the first terminals comprise a first differential pair of signal terminals, a first power terminal and a first ground terminal, the second terminals comprise a second differential pair of signal terminals, a second power terminal and a second ground terminal.

18. The waterproof connector according to claim 17, wherein the first insulating body comprises a first front body located in front of the first hollow groove, the second insulating body comprises a second front body located in front of the second hollow groove, the first front body is provided with a first high-frequency signal hole which exposes part of the first contact portions of the first differential pair of signal terminals to the first front body, and the second front body is provided with a second high-frequency signal hole which exposes part of the second contact portions of the second differential pair of signal terminals to the second front body.

19. The waterproof connector according to claim 17, wherein the first power terminal and the first ground terminal are made of copper alloy with ultra-high conductivity, and the second power terminal and the second ground terminal are made of copper alloy with ultra-high conductivity.

20. The waterproof connector according to claim 12, wherein the outer shell has a top surface and a bottom surface, the top surface is provided with a first glue pouring port communicating with the second hollow groove, the bottom surface is provided with a second glue pouring port communicating with the first hollow groove, the first sealant is poured into the first hollow groove from the second glue pouring port, and the second sealant is poured into the second hollow groove from the first glue pouring port.

* * * * *